United States Patent [19]

Suzuki et al.

[11] Patent Number: 4,727,807

[45] Date of Patent: Mar. 1, 1988

[54] APPARATUS FOR AUTOMATICALLY MOUNTING AND REMOVING PRINTING PLATES IN ROTARY PRINTING PRESS

[75] Inventors: Kunio Suzuki, Yokohama; Yukitoshi Takahashi; Nobuaki Hashimoto, both of Kawasaki, all of Japan

[73] Assignee: Tokyo Kikai Seisakusho, Tokyo, Japan

[21] Appl. No.: 891,251

[22] Filed: Jul. 28, 1986

[30] Foreign Application Priority Data

Sep. 30, 1985 [JP] Japan ..... 60-216329
May 20, 1986 [JP] Japan ..... 61-115990

[51] Int. Cl.[4] ..... B41F 27/12; B41U 29/14
[52] U.S. Cl. ..... 101/415.1
[58] Field of Search ..... 101/415.1, 136, 137, 101/138, 141, 142, 144, 378, 52–54

[56] References Cited

U.S. PATENT DOCUMENTS 3,793,950 2/1974 Kaneko et al. ..... 101/141
4,408,530 10/1983 Yano et al. ..... 101/415.1
4,417,514 11/1983 Hoshino ..... 101/54

FOREIGN PATENT DOCUMENTS 58-140254 8/1983 Japan .
58-187355 11/1983 Japan .
58-188657 11/1983 Japan .
60-52343 3/1985 Japan .
60-73850 4/1985 Japan .

*Primary Examiner*—J. Reed Fisher
*Attorney, Agent, or Firm*—Trexler, Bushnell, Giangiorgi & Blackstone, Ltd.

[57] ABSTRACT

In a rotary printing press, an apparatus, for automatically mounting and removing printing plates comprises: a magazine associated with a main body and including a plate take-out unit for positioning a plurality of successive fresh printing plates in order, and a plate storage unit for temporarily storing a plurality of used printing plates; and a mechanical hand adapted for holding a printing plate and supported by a shaft of and an arm of the main body, the mechanical hand being actuated by the shaft and arm for reciprocating between the magazine and a peripheral surface of a plate cylinder.

3 Claims, 19 Drawing Figures

APPARATUS FOR AUTOMATICALLY MOUNTING AND REMOVING PRINTING PLATES IN ROTARY PRINTING PRESS

BACKGROUND OF THE INVENTION

1. Field of the Invention

The present invention relates to a rotary printing press, and more particularly to an apparatus for automatically mounting a plurality of printing plates, each delivered to the side of a respective printing unit, on a plate cylinder at respective predetermined positions and for automatically removing each printing plate from the plate cylinder after use, the apparatus including an auxiliary apparatus adapted to rationalize the processing of fresh printing plate immediately before mounting on the cylinder and of the used printing plates immediately after removal from the cylinder.

2. Description of the Prior Art

Various apparatus for automatically mounting and removing printing plates on a plate cylinder at predetermined positions are disclosed in the applicant's Japanese Patent Laid-Open Publications Nos. 58-140254, 58-188657 and 60-216350, while an apparatus for automatically distributing the printing plates from a plate making chamber to the respective printing units is disclosed in the applicant's Japanese Patent Laid-Open Publication No. 60-52343.

Of the prior art publications mentioned above, Japanese Patent Laid-Open Publications Nos. 58-188657 and 60-73850 are directed to the apparatus of the type same as that disclosed in the present application. However, a problem with these prior apparatus is that a mechanical hand for directly retaining the printing plate during the mounting and removing thereof is too complex in construction for maintenance, thus often incuring troubles and hence impairing the efficiency.

Further, usually four rows of printing plates, two in each row, namely eight printing plates in all are mounted on a peripheral surface of the plate cylinder. To exchange the used printing plates for new ones, removing one used printing plate and then mounting one new printing must be repeated eight times. Specifically, for each exchange, the mechanical hand removes one used printing plate from the peripheral surface of the plate cylinder and then carries the removed printing plate to a plate discharging position, whereupon the mechanical hand moves to a plate introducing position to pick up one new printing plate and then brings the new printing plate onto the peripheral surface of the plate cylinder. this exchanging operation must be repeated eight times, which requires a long time and hence impairs the efficiency.

SUMMARY OF THE INVENTION

It is therefore an object of the present invention to provide an apparatus for automatically mounting and removing printing plates which apparatus can eliminate the prior art problems mentioned above.

Another object of the invention is to provide an apparatus for automatically mounting and removing printing plates in which apparatus the strokes of a mechanical hand, for bringing a new printing plate from a plate introducing position to a plate cylinder and for bringing a used printing plate from the plate cylinder to a plate discharging position, are shortened so that removing of the used printing plate and mounting of the new printing plate can take place speedily.

The first object of the invention is accomplished by an apparatus for automatically mounting and releasing a printing plate in a rotary printing press, said apparatus comprising: a mechanical hand including a retainer mechanism for retaining the printing plate, an inserter mechanism for forcing a gripping-side bent end of the printing plate into a gripping groove of a plate cylinder, a pusher mechanism for pushing the printing plate against a peripheral surface of the plate cylinder, a shaft supporting said inserter mechanism and said pusher mechanism, a base supporting said shaft such that the latter is movable when thrusted, a positioning mechanism for pivotally moving said shaft relative to said base to thereby position the printing plate on said plate cylinder at a predetermined position; a main body having a support shaft and an arm for supporting and moving said mechanical hand; an angular displacement mechanism for angularly moving a printing-plate gripping and releasing shaft of said plate cylinder; a control mechanism for controlling motions of said mechanical hand, said main body and said angular displacement mechanism in timed relation to one another for mounting and removal of the printing plate.

The second object of the invention is accomplished by an auxiliary apparatus for automatically mounting and removing a printing plate in a rotary printing press, said apparatus comprising: a main body including a shaft and an arm; a magazine associated with said main body and including a plate take-out unit for positioning a plurality of successive fresh printing plates in order, and a plate storage unit for temporarily storing a plurality of used printing plates; a mechanical hand adapted for holding a printing plate and supported by said shaft and arm of said main body, said mechanical hand being actuated by said shaft and arm for reciprocating between said magazine and a peripheral surface of a plate cylinder.

According to a third aspect of the invention, there is provided an auxiliary apparatus for automatically mounting and removing a printing plate in a rotary printing press, said apparatus comprising: a main body including a shaft and an arm; a magazine associated with said main body and including a plate take-out unit for positioning a plurality of successive fresh printing plates in order, and a plate storage unit for temporarily storing a plurality of used printing plates; a plate transportation terminal for receiving a desired number of fresh printing plates from a carrier, adapted to transport the fresh printing plates to respective printing units, and for temporarily storing the received fresh printing plates in order; and a mechanical hand adapted for holding a printing plate and supported by said shaft and arm of said main body, said mechanical hand being actuated by said shaft and arm for reciprocating between said terminal and said magazine, and between said magazine and a peripheral surface of a plate cylinder.

According to a fourth aspect of the invention, there is provided by an auxiliary apparatus for automatically mounting and removing a printing plate in a rotary printing press, said apparatus comprising a main body including a shaft and an arm; a magazine associated with main body and including a plate take-out unit for positioning a plurality of successive fresh printing plates in order, and a plate storage unit for temporarily storing a plurality of used printing plates; a plate transportation terminal for receiving a desired number of fresh printing plates from a carrier, adapted to transport the fresh printing plates to respective printing units, and for temporarily storing the received fresh printing plates in order, said terminal being disposed at such a position that said terminal agrees with said magazine in level and orientation in the direction of transporting the printing plates; means for shifting said main body longitudinally along said plate cylinder; and a mechanical hand adapted for holding a printing plate and supported by said shaft and arm of said main body, said mechanical hand being actuated by said shaft and arm for reciprocating between said magazine and a peripheral surface of a plate cylinder and also for connecting said magazine and said terminal with another.

Many other advantages and features and additional objects will become apparent manifest to those versed in the art upon making reference to the detailed description and the accompanying drawings in which certain embodiments incorporating the principles of the present invention are shown by way of illustrative example.

DETAILED DESCRIPTION

Figure 2:
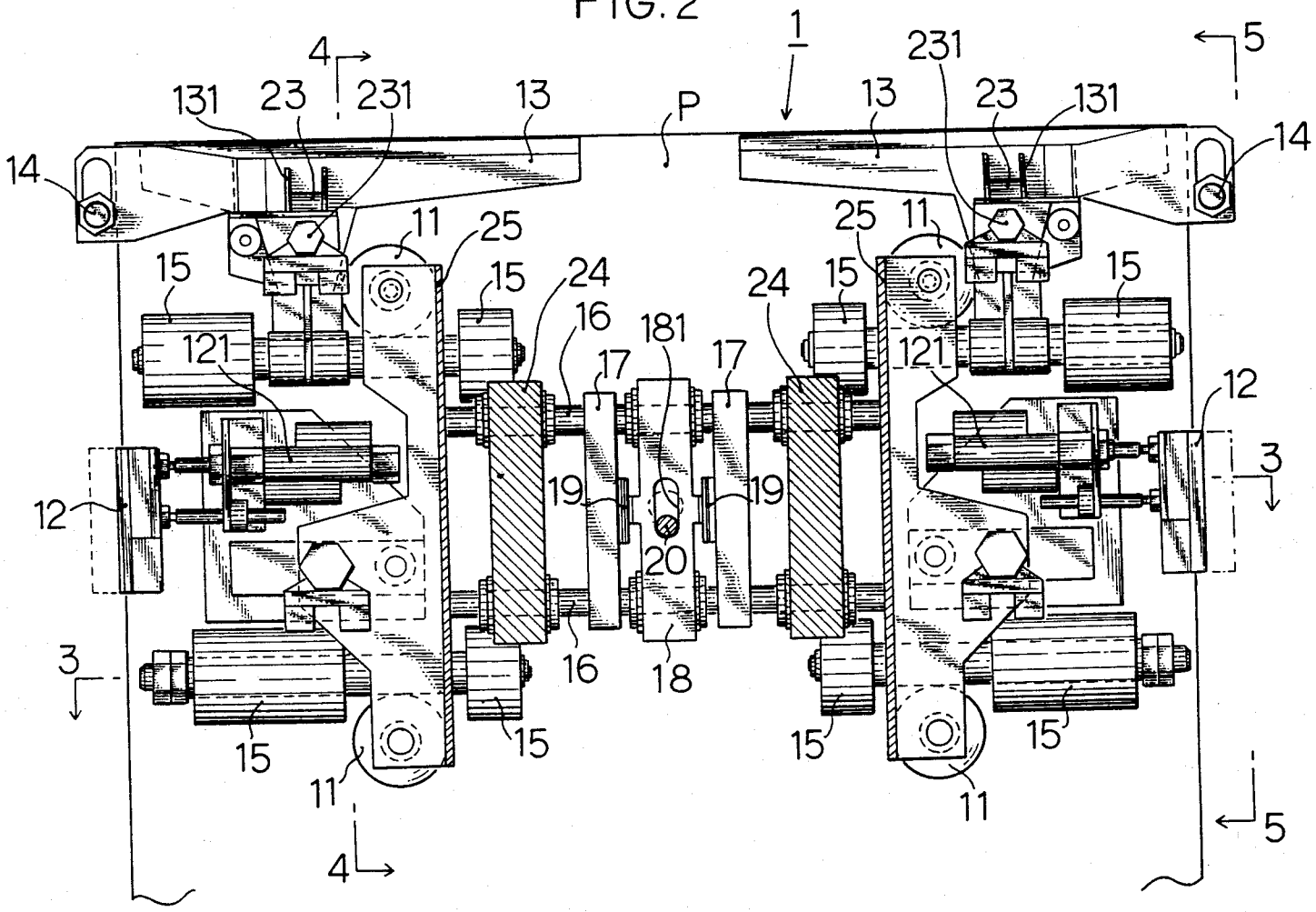
FIG. 2 is a vertical rear cross-sectional view taken along line 2—2 of FIGS. 1 and 3.
Figure 3:
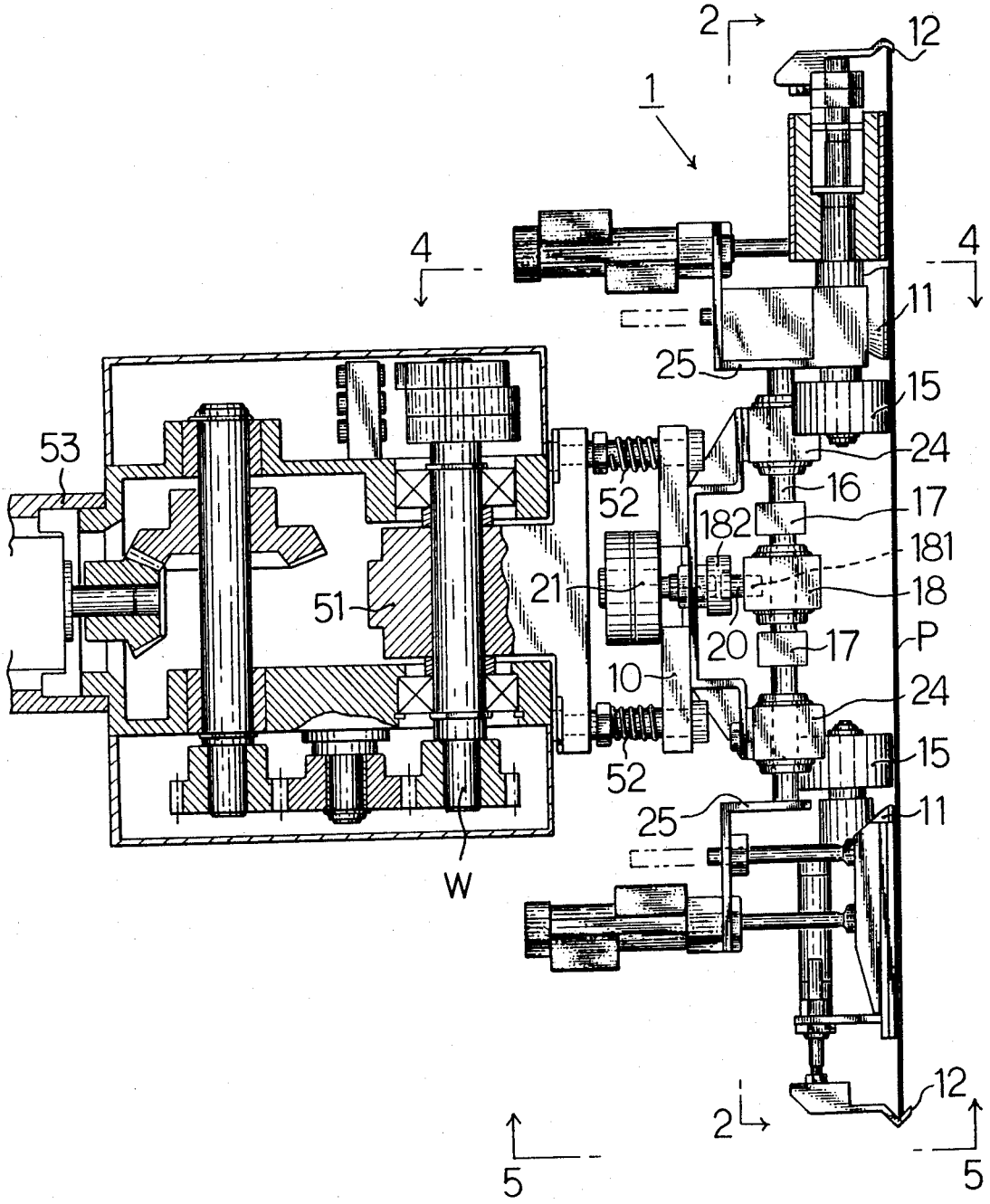
FIG. 3 is a horizontal front cross-sectional view taken along line 3—3 of FIGS. 1 and 2.

As shown in FIGS. 2 and 3, a mechanical hand 1 for mounting and removing a printing plate is composed of various members on a base 10. The base 10 is secured to a wrist 51 of a main body 5 via a compression spring 52. A pair of shafts 16, 16 is journaled by a pair of brackets 24, 24 projecting forwardly from the base 10. The shafts 16, 16 are axially movable on the brackets 24, 24 when the shafts 16, 16 are thrusted. A block 18 is slidably supported centrally on the pair of shafts 16, 16, which extend through the block 18. A pair of blocks 17, 17 is fixedly mounted on the pair of shafts 16, 16 and is disposed one at each side of the block 18. Also, a pair of brackets 25, 25 is fixedly mounted on the pair of shafts 16, 16 at opposite end portions thereof, each bracket 25 being disposed outwardly of a respective one of the brackets 24.

The central block 18 has a vertical slot 181 in which a pin 20 mounted eccentrically on a disk 182 is slidably received, the center of the disk 182 being operatively connected to a motor 21 for rotation in either direction. As the motor 21 rotates, the pin 20 pivots to more the block 18 leftwardly and rightwardly. Further, a pair of load cells 19, 19 (FIG. 2) for the purposes of pressure detection is mounted between the leftside block 17 and the central block 18 and between the latter and the rightside block 17, respectively, each load cell 19 having a thickness substantially equal to the distance between the central block 18 and the respective side block 17.

Figure 1:
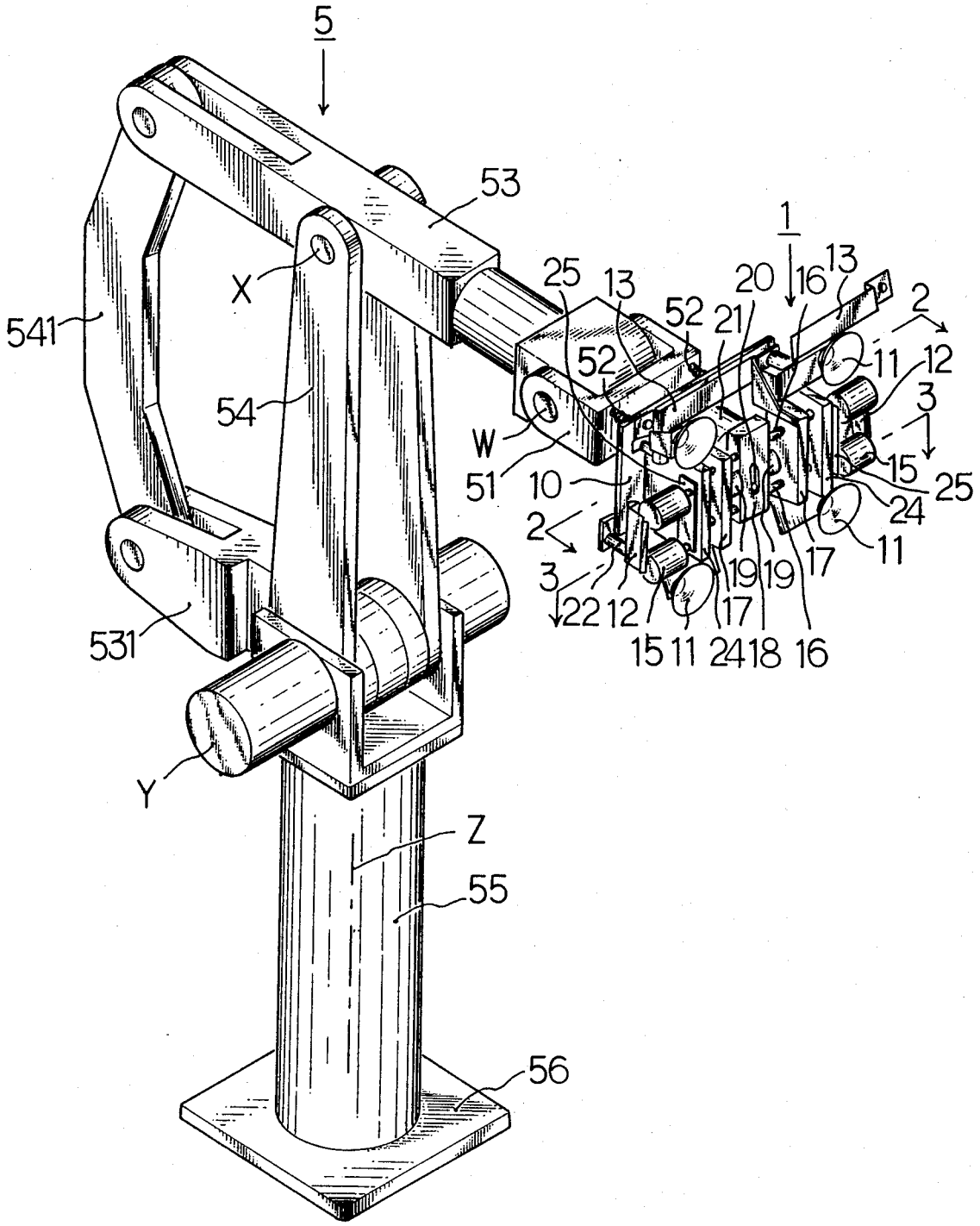
FIG. 1 is a perspective view, with parts broken away, of a principal portion of an automatic printing-plate mounting and removing apparatus embodying the present invention.

Two pairs of sucking disks 11, 11 and 11, 11 for retaining a printing plate P is mounted one pair on each of the outer brackets 25, 25 fixedly secured to the shafts 16, 16. A pair of claws 12, 12 for gripping the printing plate P. An air cylinder 121 for moving the claws 12, 12 leftwardly and rightwardly toward and away from each other, and an air cylinder 22 (FIGS. 1 and 3) for moving the claws 12, 12 forwardly and rearwardly, are fixedly mounted on each outer bracket 25 via a unnumbered bracket. Thus in the illustrated embodiment all of these members are attached to the brackets 25, 25 via the unnumbered brackets. As desired, the sucking disks 11, 11 or the claws 12, 12 may be omitted.

A pair of pushing plates 13, 13 is mounted on a pair of levers 131, 131 at their respective free ends for forcing a gripping-side bent end portion of the printing plate P into a gripping groove of a plate cylinder A. the base of each lever 131 is supported by a pin 23 which is connected to a piston rod of an air cylinder 231; the pin 23 and the air cylinder 231 are attached to each of the brackets 25, 25 fixedly secured to the shafts 16, 16. The pin 23 and the cylinder 231 may be attached to each of the blocks 17, 17 fixedly secured to the shafts 16, 16. Therefore, the pushing plate 13 is angularly movable about the pin 23 upon actuation of the air cylinder 231. Thus in the illustrated embodiment all of these members are attached to the brackets 25, 25 via the unnumbered brackets. A proximity switch 14 is supported on each of the pushing plates 13 for confirming whether the gripping-side bend end of the printing plate P has been forced into the gripping groove of the plate cylinder A.

A pair of rollers 15, 15 is supported by each of the brackets 25 fixedly secured to the shafts 16, 16 and is disposed on the outer side of each bracket 25. The rollers 15, 15 serve to push the printing plate P against the plate cylinder A. Alternatively, an endless belt may be used instead of these rollers 15, 15.

The main body 5 includes a lower link 53 pivotally connected to the wrist 51 by a wrist axle W, an upper link 54 pivotally connected to the lower link 53 by an elbow axle X, a post 55 connected to the lower link 54 by a shoulder axle Y, the post 55, and a base 56 supporting the post 55. The post 55 serves as a Z axis which is horizontally rotatable with respect to the base 56. A rotatable wheel (not shown) may be mounted on the underside of the base 56. The rear end of the lower link 53 is pivotally connected to a first auxiliary link 541 parallel to the upper link 54, the auxiliary link 541 being pivotally connected to a second auxiliary link 531 parallel to the lower link 53.

Figure 6:
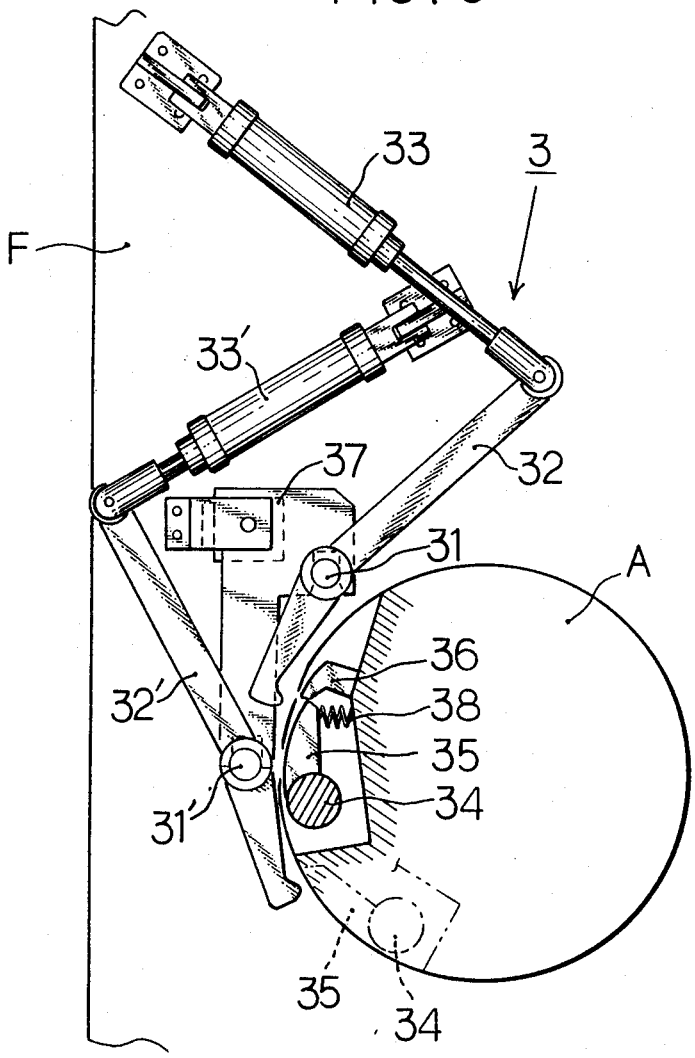
FIG. 6 is a vertical side cross-sectional view of an auxiliary part of the apparatus, showing the manner in which a shaft for gripping and releasing a trailing end of a printing plate is rotated.
Figure 7:
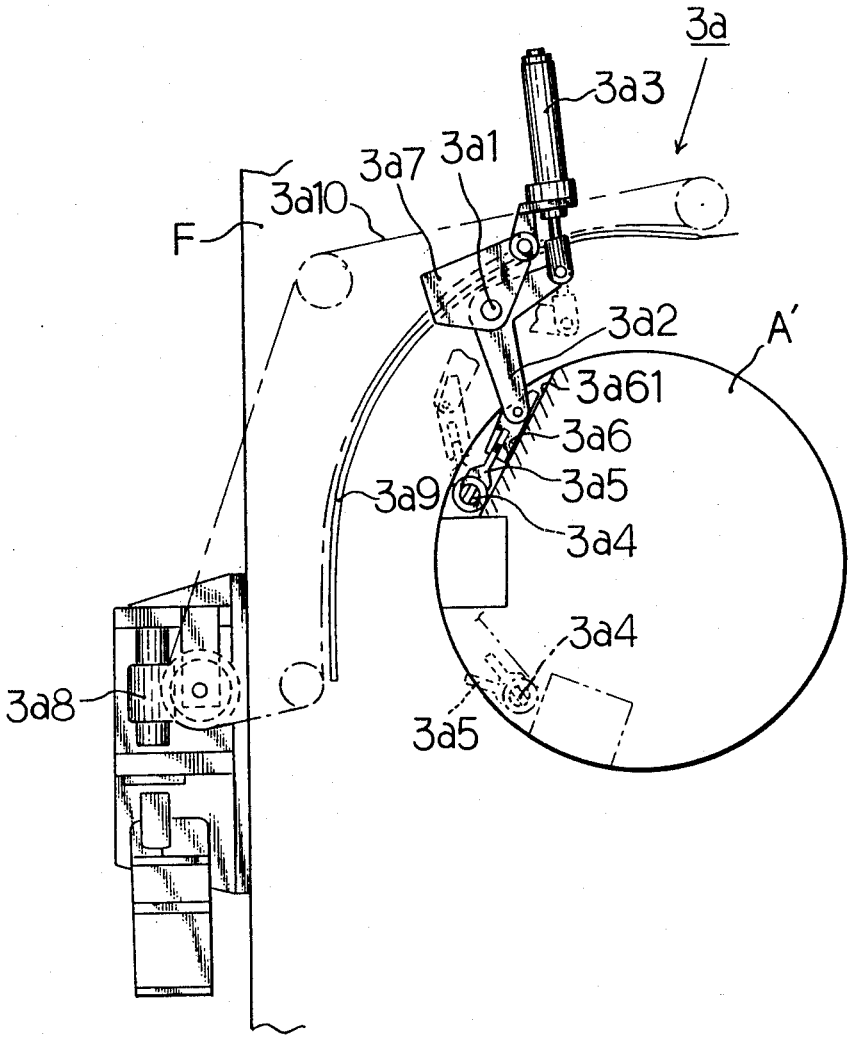
FIG. 7 is a vertical side cross-sectional view similar to FIG. 6, but showing a modified auxiliary part.

In the embodiment of FIG. 6 or 7, a shaft 34 or 3a4 for gripping and releasing a gripping-side end of the printing plate P is mounted on the plate cylinder A or A', while a mechanism 3 or 3*a* for angularly displacing the shaft 34 or 3a4 is mounted on a frame F of a rotary printing press.

Specifically, in the embodiment of FIG. 6, the gripping and releasing shaft 34 extends longitudinally of the plate cylinder A along the peripheral surface thereof; the printing plate P is mounted on the plate cylinder A when the gripping and releasing shaft 34 is at a phase indicated by solid lines, and is removed from the plate cylinder A when the gripping and releasing shaft 34 is at a phase indicated by dash-and-two-dot lines.

An arm 35 projects from the gripping and releasing shaft 34 and is normally urged by a spring 38 to pivot counterclockwise, and this counterclockwise pivotal movement of the arm 35 is restricted by a stop 36 which is engageable with a free end of the arm 35. When the arm 35 is pushed inwardly against the bias of the spring 38, the gripping and releasing shaft 34 is angularly displaced or moved clockwise; in this angularly displaced position, gripping and releasing of the gripping-side end of the printing plate P take place.

In an example, a means for pushing the free end of the arm 35 inwardly, may include a pair of straight levers 32, 32 centrally pivoted by a pair of pins 31, 31, respectively, one end of each lever 32 being connected to a drive unit, such as a piston rod of an air cylinder 33, 33' so that the other end of each lever 32, 32' can push the free end of the arm 35 when the gripping and releasing shaft 34 is at the gripping phase and also when the gripping phase and also when the gripping and releasing shaft 34 is at the releasing phase.

In a double width rotary printing machine, usually the gripping and releasing shaft 34 has a double structure in which two arms 35, 35 are spaced away from each other longitudinally of the plate cylinder A. To cope with this double arm 35, a shift means 37 is used for shifting the pair of levers 32, 32'.

In the embodiment of FIG. 7, like the embodiment of FIG. 6, the gripping and releasing shaft 3a4 extends longitudinally of the plate cylinder A along the peripheral surface thereof; the printing plate P is mounted on the plate cylinder A when the gripping and relasing shaft 3a4 is at a phase indicated by solid lines, and is removed from the plate cylinder A when the gripping and releasing shaft 3a4 is at a phase indicated by dash-and-two-dot lines. But in the embodiment of FIG. 7, gripping and releasing of the gripping-side end portion of the printing plate takes place when the arm 3a5 projecting from the gripping and releasing shaft 3a4 is at a position (broken-line position) that is angularly displaced counterclockwise. During printing and a pause of operation, the arm 3a5 is at an original position (solid-line position) that is angularly displaced clockwise.

In an example, the means for angularly moving the arm 3a5 may include a bell crank lever 3a2 pivotally connected at its midportion to a bracket 3a7 by a pin 3a1. One end of the lever 3a2 is connected to a piston rod of an air cylinder 3a3, while a bifurcated bar 3a5 is pivotally connected at its base to the other end of the lever 3a2 for catching the free end of the arm 3a5. Accordingly, the bell crank lever 3a2 is pivotally movable, about the pin 3a1, between the solid-line position and the broken-line position. In response to this pivotal movement of the lever 3a2, the arm 3a5 is movable between the solid-line position and the broken-line position via the bifurcated bar 3a6. Reference numeral 3a61 designates a guide surface which serves to assist in connecting the arm 3a5 and the bifurcated bar 3a6 to each other reliably. Since the shaft 3a4 has dead points at a printing-plate holding position (solid-line position) and at a printing-plate holding position (broken-line position), the shaft 3a4 is not angularly movable until an exterior force is exerted on the shaft 3a4 so as to over the dead points.

While the printing machine is in operation, usually the bifurcated bar 3a6 is preferably stood-by at a position remote from the plate cylinder A'. To move the bifurcated bar 3a6 to this stand-by position, the bracket 3a7 is moved by a chain counterclockwise, namely, in the direction of drawing the bifurcated bar 3a6 away from the arm 3a5, and then the piston rod of the air cylinder 3a3 is extended to bring the bifurcated bar 3a6 away from the plate cylinder A' to thereby return to the stand-by position.

For angularly moving the gripping and releasing shaft 3a4, firstly the chain 3a10 is moved counterclockwise to bring the bracket 3a7, with its associated members, until the bracket 3a7 arrives at a position past a front end of the arm 3a5. Then the piston rod of the air cylinder 3a3 is extended to bring, via the bell crank lever 3a2, the bifurcated bar 3a6 into contact with the guide surface 3a61 of the plate cylinder A, whereupon when the chain 3a10 is moved clockwise, the bifurcated bar 3a6 is guided on the guide surface 3a61 of the plate cylinder A to catch the free end of the arm 3a5 that is in the plate holding position.

In this position, when the piston rod of the air cylinder 3a3 is extended, the arm 3a5 is angularly moved to the broken-line position so that mounting and removing of a printing plate can take place. Reversely, if the piston rod of the air cylinder 3a3 is shrunk, the arm 3a5 is angularly moved to the solid-line position so that printing and a pause of operation can take place.

In this embodiment of FIG. 7, the bifurcated bar 3a6 is used in both mounting of the printing plate (solid-line phase) and removing of the printing plate (dash-and-two-dot-line phase). Therefore, the bracket 3a7 supporting the bifurcated bar 3a6 must be moved between the above two phases. One example of the means for moving the bifurcated bar 3a6 is as follow. The bell crank lever 3a2 and the air cylinder 3a3 are supported by the bracket 3a7 fixedly connected to a point of the endless chain 3a10. On the other hand, the chain 3a10 is guided along an arcuate rail 3a9 concentric with the peripheral surface of the plate cylinder A, and is driven by the output-side sprocket of the drive 3a8 which is rotatable in either direction.

Accordingly, after the chain 3a10 is moved in such a direction that the bifurcated bar 3a6 is removed from the arm 3a5, the piston rod of the air cylinder 3a3 is extended to bring the bifurcated bar 3a6 outwardly of the peripheral surface of the plate cylinder A'. In this position, when the chain 3a10 is lowered along the rail 3a9, the bifurcated bar 3a6 is moved onto the plate removal phase (dash-and-two-dot lines).

In the double width rotary printing machine, usually the gripping and releasing shaft 3a4 has a double structure in which two arms 3a5 are spaced away from each other longitudinally of the plate cylinder A. To cope with this double arm 3a5, 3a5, two bell crank levers 3a2, 3a2, two air cylinders 3a3, 3a3 and two bifurcated bars 3a6, 3a6 are necessary.

The procedure of mounting the printing plate will now be described in connection with FIG. 8A–G.

Figure 8:
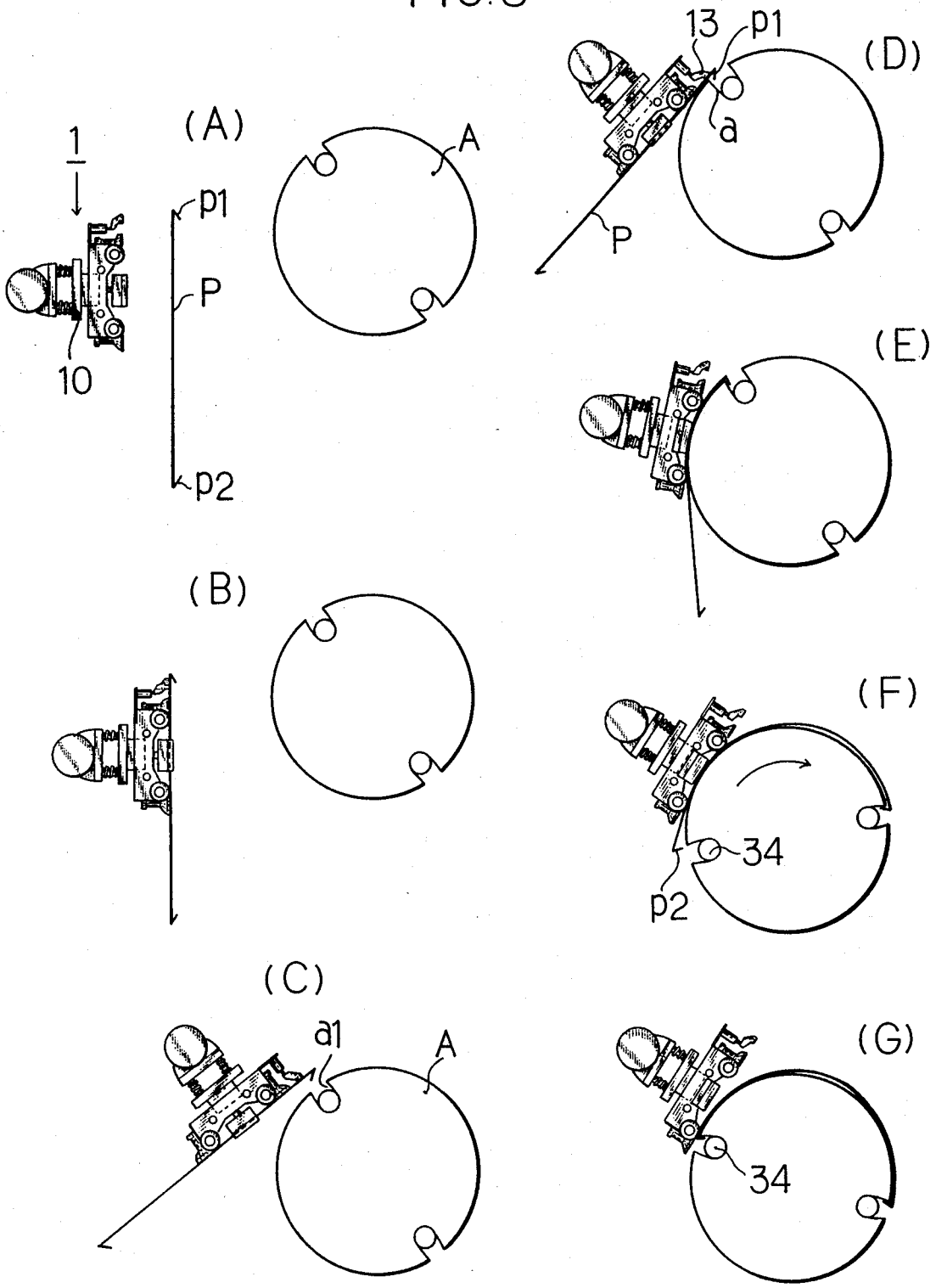
FIG. 8 illustrates the manner in which a printing plate is mounted on a printing drum.

1. For bringing the mechanical hand 1, waiting at a predetermined position, close to the printing plate P waiting at a predetermined position, the wrist axle W, the elbow axle X, the shoulder axle Y and the waist axis Z, all of the main body 5, are rotated individually to a suitable extent so as to bring the mechanical hand 1 to a position substantially the same level with the gripping-side bent end P1 of the printing plate P and so as to stop the mechanical hand 1 at such a position that the base 10 is parallel to the printing plate 1. (FIG. 8A)

2. When four sucking disks 11, 11, 11, 11 are attached to the outer surface of the printing plate P by the action of sucking, and also when the rightside and leftside claws 12, 12 are actuated, the printing plate P is held by the mechanical hand 1 as the rightside and leftside edges of the plate P are gripped. Confirmation of this sucking and holding is made by detecting a reduction of pressure by a pressure detection switch (not shown) at a vacuum source. (FIG. 8B)

3. With the printing plate thus held, the hand 1 is again moved, by rotating each axle of the main body, until the gripping-side bent end P1 of the printing plate P is brought close to the gripping groove a1 of the plate cylinder A. (FIG. 8C)

4. On the other hand, in order to stop the plate cylinder A in a phase registered with the plate mounting position, any positional error is detected by the number of bits of a rotary encoder 002 (FIG. 10), and if necessary, the plate cylinder A is further moved to the plate mounting position. (FIG. 8C)

5. Then, the pusher plates 13, 13 of the mechanical hand 1 are driven by the air cylinders 231, 231 to force the gripping-side bent end P1 of the printing plate P into the gripping groove a1 of the plate cylinder A. Confirmation of this insertion is made by detecting the peripheral surface of the plate cylinder A by proximity switches 14, 14. (FIG. 8D)

6. As the block 18 is moved to the right or left by the motor 21 of the mechanical hand 1, the blocks 17, 17 are pushed via the pressure detection load cells 19, 19, and the brackets 25, 25 are displaced via the shafts 16, 16. This displacement is transmitted to the sucking disks 11, 11 and the claws 12, 12 mounted on the brackets 25, 25 via the unnumbered bracket and is then transmitted to the printing plate P supported by the sucking disks 11, 11 and the claws 12, 12. Then the printing plate P comes into abutment with a plate positioning stop (not shown) of the plate cylinder A. The counter force created at that time is detected by the pressure detection load cells 19, 19 disposed between the blocks 17, 18; the motor 21 is terminated according to the detected value. (FIG. 8D)

Figure 4:
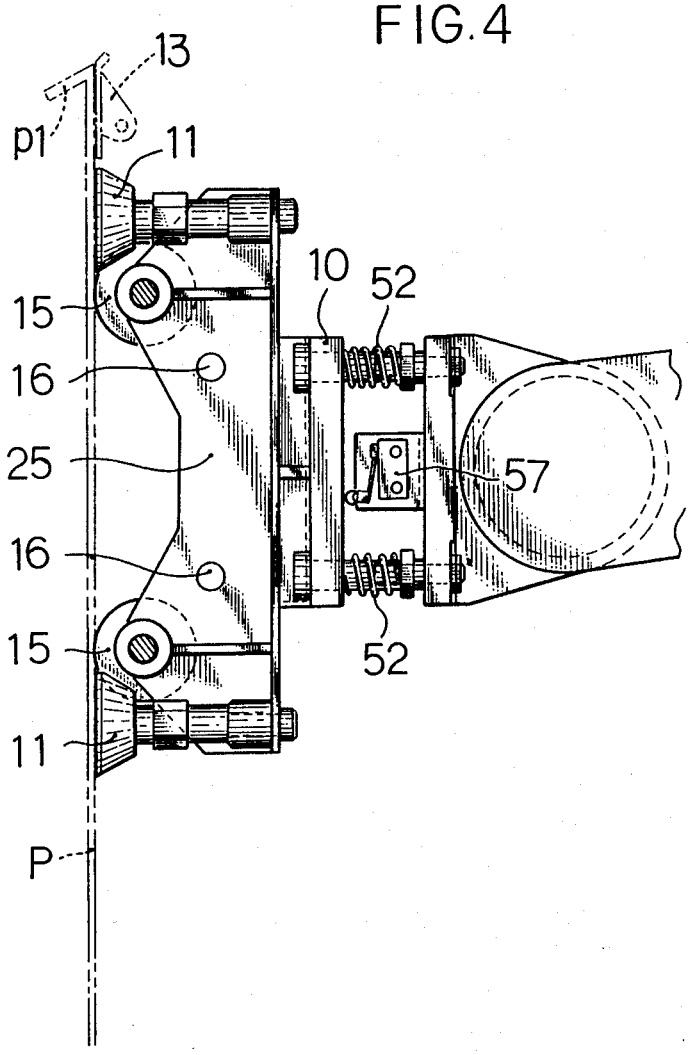
FIG. 4 is a vertical rightside cross-sectional view taken along line 4—4 of FIGS. 2 and 3.
Figure 5:
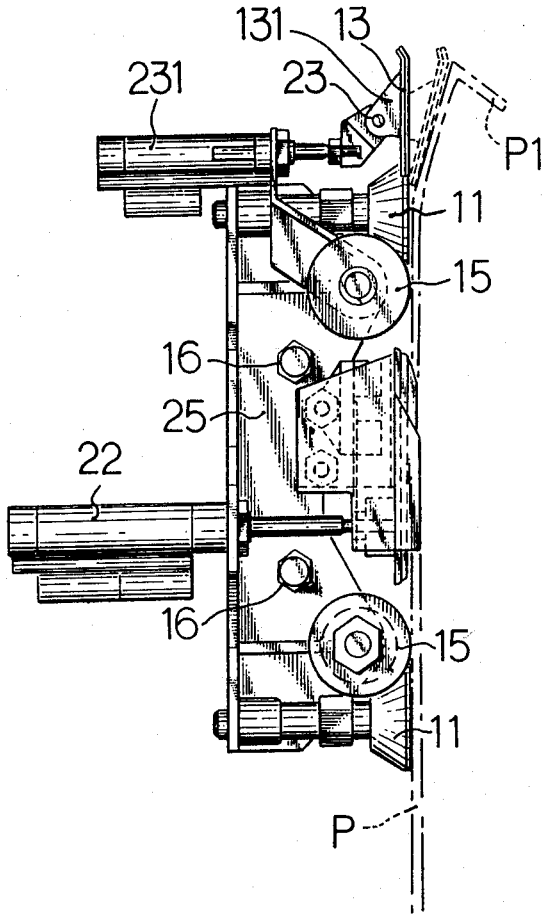
FIG. 5 is a leftside elevational view taken along line 5—5 of FIGS. 2 and 3.

7. With displacing the mechanical hand 1 from the position of FIG. 8D to the position of FIG. 8E by moving properly each axle W, X, Y of the main body 5, the gripping-side bent end P1 of the printing plate P is hooked on the edge of the gripping groove a1 of the plate cylinder A, and the printing plate P is pushed against the peripheral surface of the plate cylinder A by the rollers 15. Confirmation of this pushing is made by a limit switch 57 (FIG. 4). In the meantime the printing plate P is released from the sucking disks 11, 11 and the claws 12, 12; this releasing is made by a pressure detection switch (not shown) at the vacuum source. (FIG. 8E)

Figure 10:
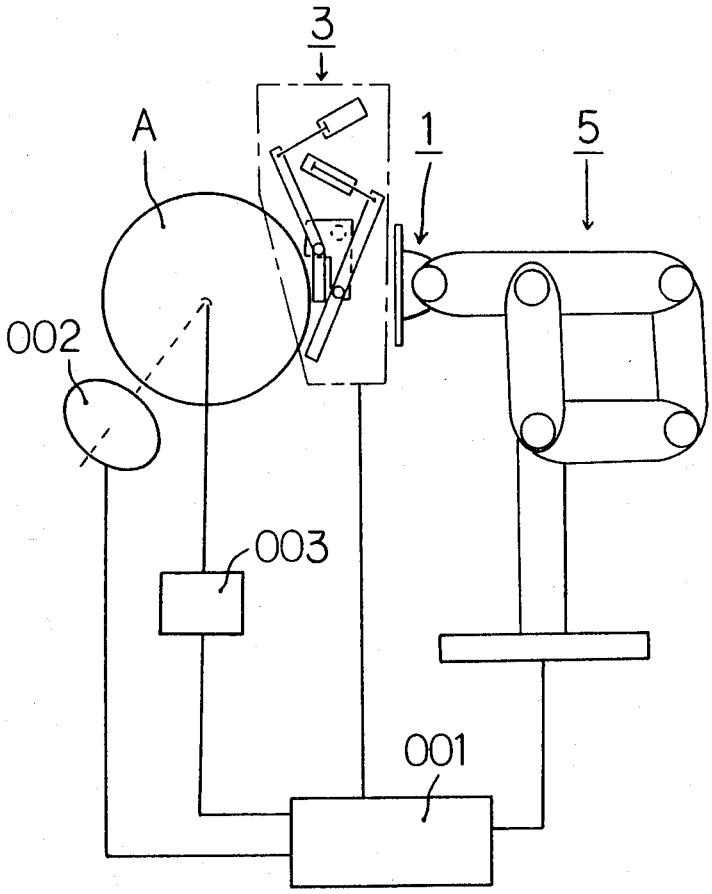
FIG. 10 is a schematic view showing a control system for the embodiment employing the mechanism of FIG. 6.

8. As the printing drum A is rotated clockwise, the gripping-side bent end P1 of the printing plate P is moved along with advancing of the edge of the gripping groove a1 of the plate cylinder A, and the printing plate P is pushed against the peripheral surface of the plate cylinder A by the rollers 15. Therefore, the printing plate P is curved in conformity with the curvature of the peripheral surface of the plate cylinder A. And as a trailing bent end P2 of the printing plate P approaches the gripping and releasing shaft 34 of the plate cylinder A, the rotation of the plate cylinder A is terminated. Detection of this stopped position is made by a rotary encoder 002 (FIG. 10). (FIG. 8F)

9. The gripping and releasing shaft 34 or 3a4 of FIG. 6 or 7 is angularly moved to open.

Specifically, in FIG. 6, with the piston rod of the air cylinder 33 shrunk, as the straight lever 32 is pivotally moved about the pin 31 to push the free end of the arm 35 against the bias of the spring 38 by the free end of the lever 32, the shaft 34 is angularly displaced clockwise to open. Confirmation of this angular displacement is made by a limit switch (not shown) located at the end of the stroke of the air cylinder 33.

In FIG. 7, when the bell crank lever 3a2 is angularly displaced to the broken-line position as the bifurcated bar 3a6 catches the arm 3a5 and the piston rod of the air cylinder 3a3 is extended, the arm 3a5 also is angularly displaced to the broken-line position by the bifurcated bar 3a6. As a result, the shaft 3a4 is angularly displaced counterclockwise to open.

10. The mechanical hand 1 is moved toward the shaft 34 by rotating each axle of the main body 5, thereby inserting the trailing bent end P2 of the printing plate P into the portion of the shaft 34. (FIG. 8G)

11. The shaft 34 or 3a4 is closed to retain the printing plate P.

Specifically, in FIG. 6, with the piston rod of the air cylinder 33 shrunk, as the straight lever 32 is pivotally moved about the pin 31 to release the free end of the lever 32 off the free end of the arm 35, the arm 35 returns to the position of the stop 36 under the bias of the spring 38, thus causing the shaft 34 to be angularly displaced counterclockwise to complete closing operation.

In FIG. 7, when the arm 3a5 is angularly displaced to the solid-line position by shrinking the piston rod of the air cylinder 3a3, the shaft 3a4 is angularly displaced clockwise to close. Then, the arm 3a5 is released off the bifurcated bar 3a6 to return the stand-by position.

12. The mechanical hand 1 is returned to the initial stand-by position by rotating each axle of the main body 5.

The procedures of removing the printing plate P will now be described in connection with FIG. 9A–F.

Figure 9:
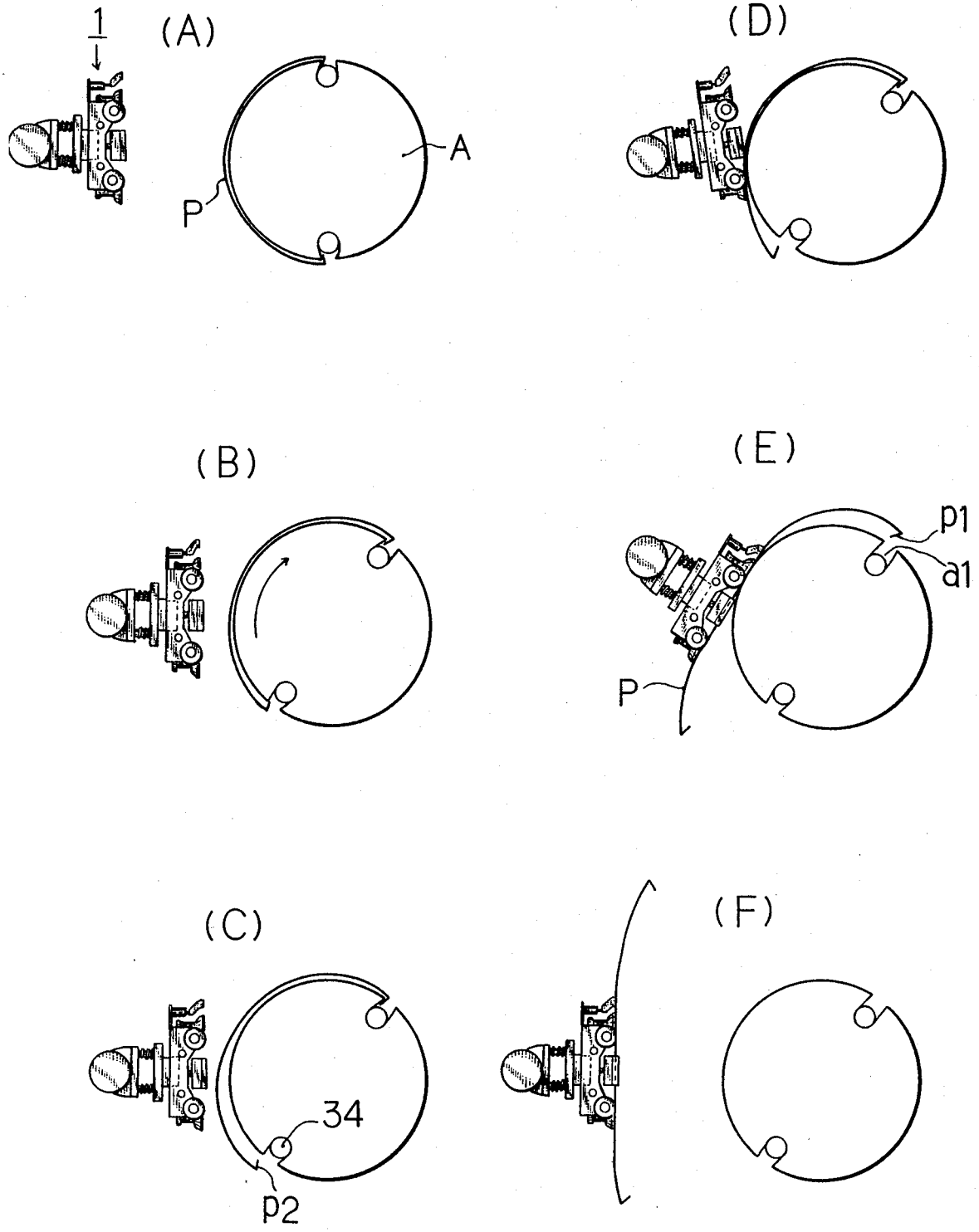
FIG. 9 illustrates the manner in which the printing plate is removed from the printing drum.

1. The mechanical hand 1 (FIG. 9A) waiting at the initial position is moved close to the printing drum A by moving each axle of the main body 5. (FIG. 9B)

2. On the other hand, confirmation as to whether the plate cylinder A is stopped in the plate releasing phase, is made by the number of bits of the rotary encoder 002 (FIG. 10). If the plate cylinder A is not stopped at the plate releasing phase, the plate cylinder A is further rotated to the plate releasing position. (FIG. 9B)

3. The shaft 34 or 3a4 is rotated to open, in the same manner as described above at paragraph 9 of the procedures of plate mounting.

But the predetermined stop position of the plate cylinder A when removing the printing plate P is the phase indicated by dash-and-two-dot-lines in FIGS. 6 and 7.

Therefore, in FIG. 6, using the pin 31', the lever 32' and the air cylinder 33', when the piston rod of the air cylinder 33' is extended, the shaft 34 is opened so that the trailing bent end P2 of the printing plate P is removed from the plate cylinder A to float off the peripheral surface of the plate cylinder A. (FIG. 9C)

In FIG. 7, as the shaft 3a4 is moved to the plate releasing position in the same manner as described above at paragraph 9 of the procedures of plate removing, the trailing bent end P2 of the printing plate P is removed from the plate cylinder A' to float off the peripheral surface of the plate cylinder A'.

4. By rotating each axle of the main body 5, the mechanical hand 1 is moved so as to contact the printing plate P, and the sucking disks 11 and the claws 12 retain the printing plate P. Confirmation of this retaining is made by each detection switch described at paragraph 2 of the procedures of plate mounting. (FIG. 9D)

5. Further, by rotating each axle of the main body 5, the mechanical hand 1 is moved to release or unhook the gripping-side bent end P1 of the printing plate P off the edge of the gripping groove a1 of the plate cylinder A. (FIG. 9E)

6. Moreover, by rotating each axle of the main body 5, the mechanical hand 1 retaining the printing plate P is moved to the plate discharging position. (FIG. 9F)

7. The shaft 34 or 3a4 is angularly displaced to close.

8. Retaining or holding of the printing plate P by the sucking disks 11 and the claws 12 is released, and then the printing plate P is disposed as desired. Confirmation of this releasing is made by each detection switch.

9. By moving each axle of the main body 5, the hand 1 is returned to its initial stand-by position.

The above operation of various parts is controlled and performed by a Central Processing Unit.

In the case where the main body 5 is movable by itself, a control system for course of travel of the main body and for the predetermined stop position must be added.

Figure 13:
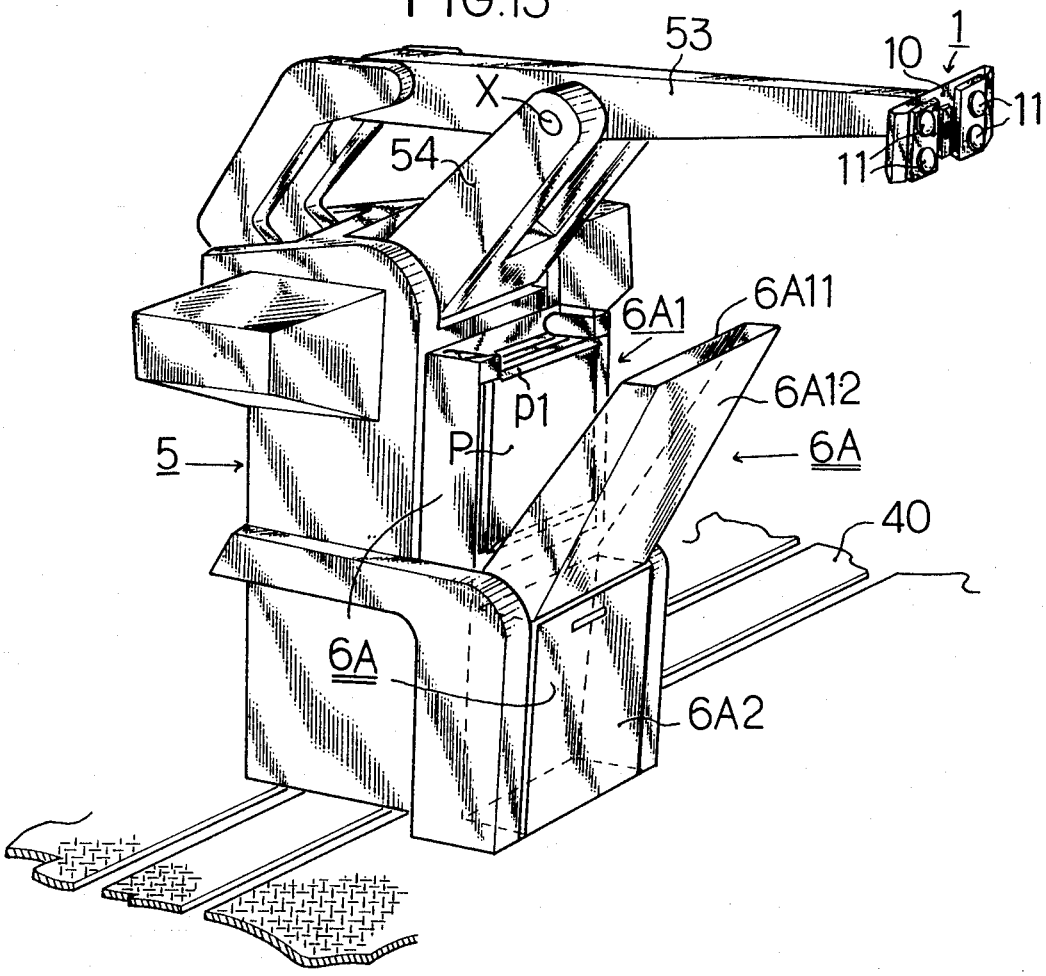
FIG. 13 is a perspective view showing a second embodiment of the auxiliary mounting and removal apparatus.

As shown in FIG. 13, the mechanical hand 1 has a plurality of (four, for example) sucking disks 11; upon receipt of a negative pressure, the sucking disks 11 can be attached to the surface of the printing plate P to thereby retain the printing plate P, and upon release of this negative pressure, the sucking disks 11 can be detached from the surface of the printing plate P to thereby release the printing plate P.

The remaining mechanisms mounted on the base 10 of the mechanical hand 1 are remote from the subject matter of the present invention, and therefore their description, and therefore their description here is omitted for clarity.

Figure 16:
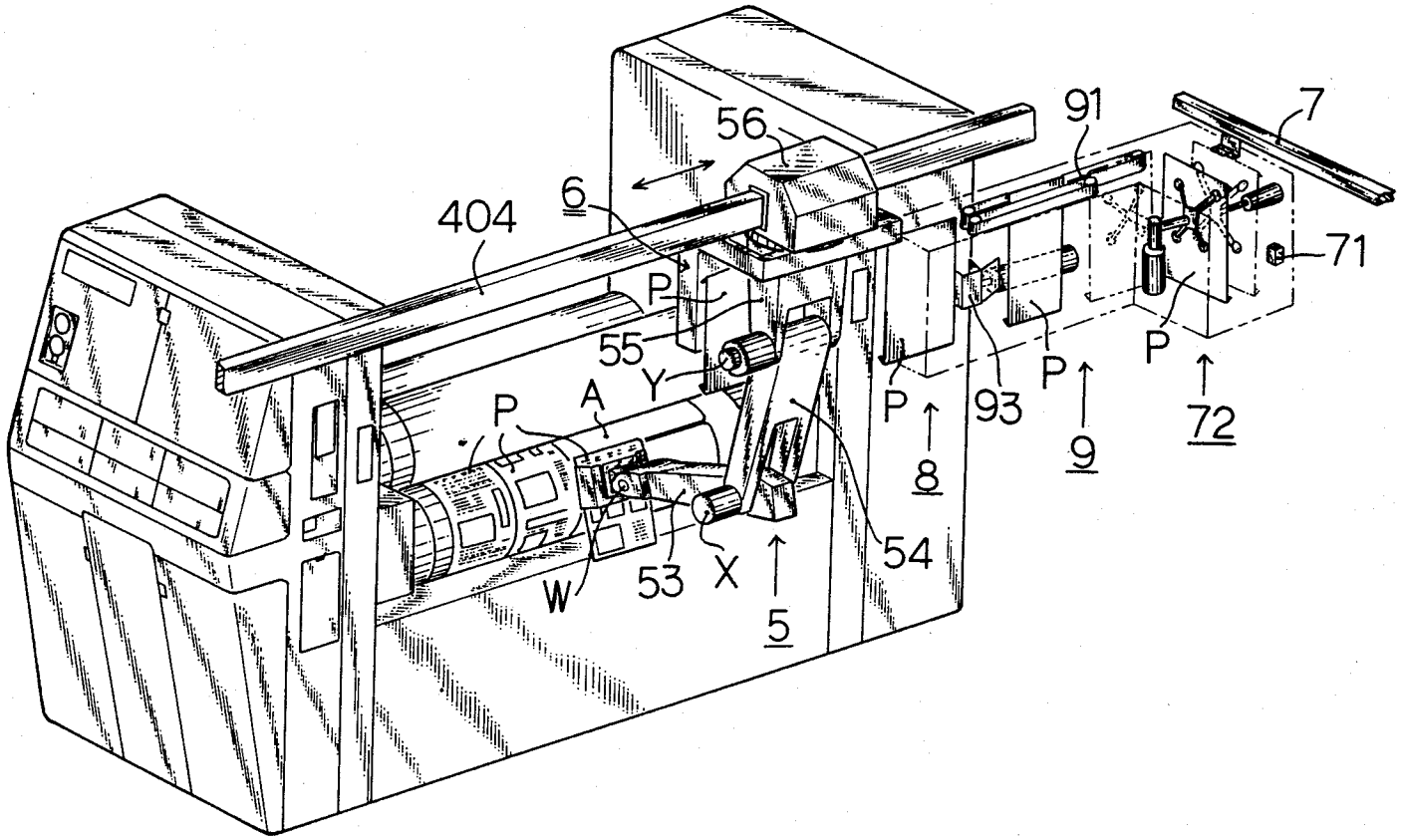
FIG. 16 is a perspective view showing a modified form of the first embodiment of FIG. 11.

The mechanical hand 1 is supported by the main body 5, which is mounted on the floor (FIGS. 11, 13), for example, or hanging from a beam 404 of the ceiling (FIG. 16).

Figure 11:
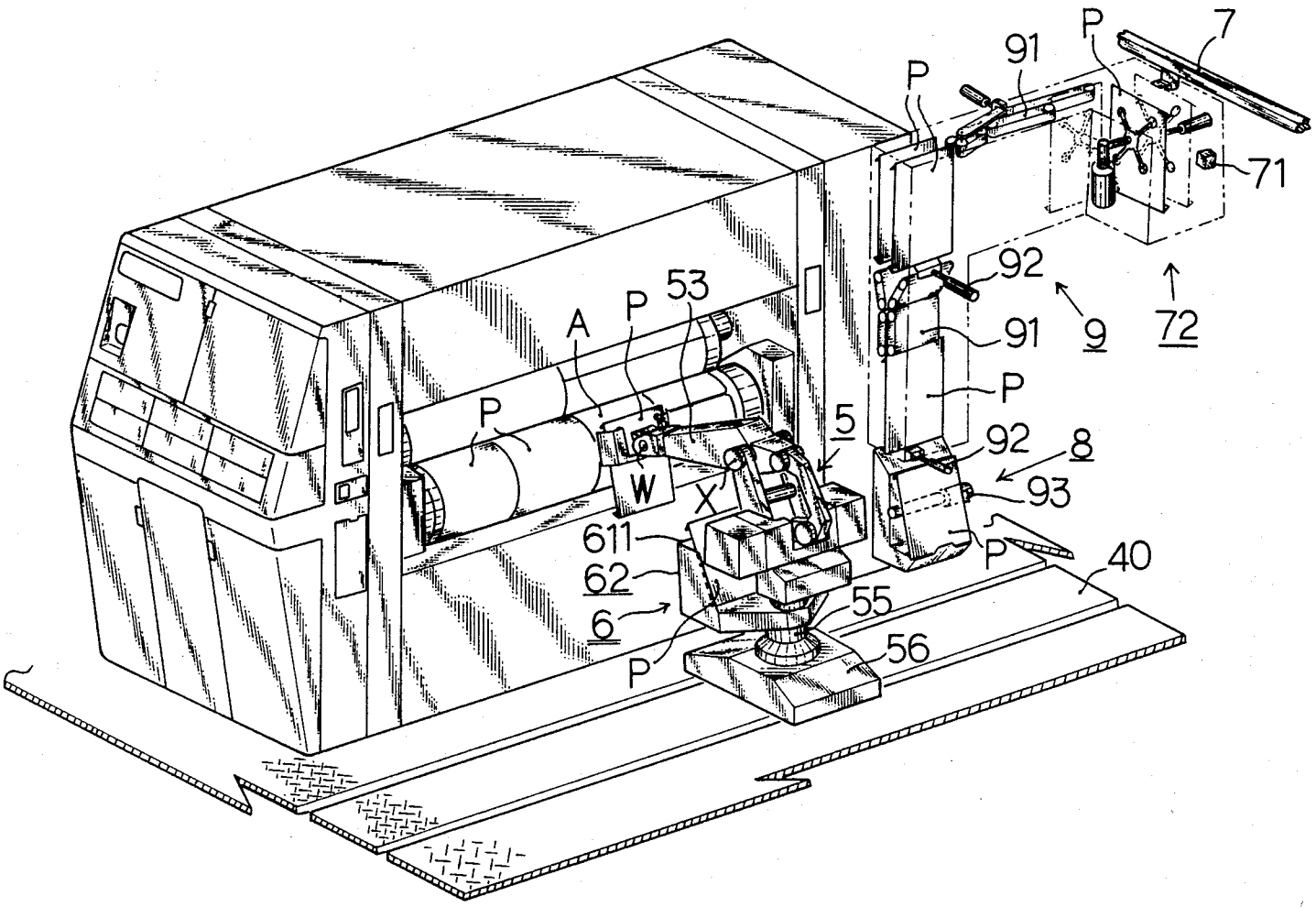
FIG. 11 is a perspective view showing a first embodiment of an auxiliary apparatus for plate mounting and removal.

The main body 5 is generally composed of the lower link 53, the upper link 54, the post 55, and the base 56. The mechanical hand 1 is pivotally connected to the lower link 53 by the wrist axle W (FIGS. 11 and 16), and the lower link 53 is in pivotally connected to the upper link 54 by the elbow axle X. Further, the upper link 54 is connected to the post 55 by the shoulder axle Y (FIG. 16), and the post 55 is rotatably mounted on the base 56 (FIG. 11).

The magazine 6 is associated with the main body 5 at such a position that the mechanical hand 1 can reach the magazine 6 and that motion of the mechanical hand 1 is not obstructed by the magazine 6. Usually, as shown in FIG. 11 and 13, it is most suitably that the magazine 6 is located in front of the main body 5 in confronting relation to the plate cylinder A and with a predetermined space from the main body. In the case of the hanging mechanical hand 1 of FIG. 16, it is most suitable that the magazine 6 is located in front of the main body 5 with a predetermined space therefrom.

The magazine 6 includes a fresh-plate take-out unit 61, and a used-plate temporary storage unit 62. These two units 61, 62 may be a stationary type (FIG. 11) in which they are fixed to the main body 5, or a detachable cassette type (FIG. 13).

Figure 12:
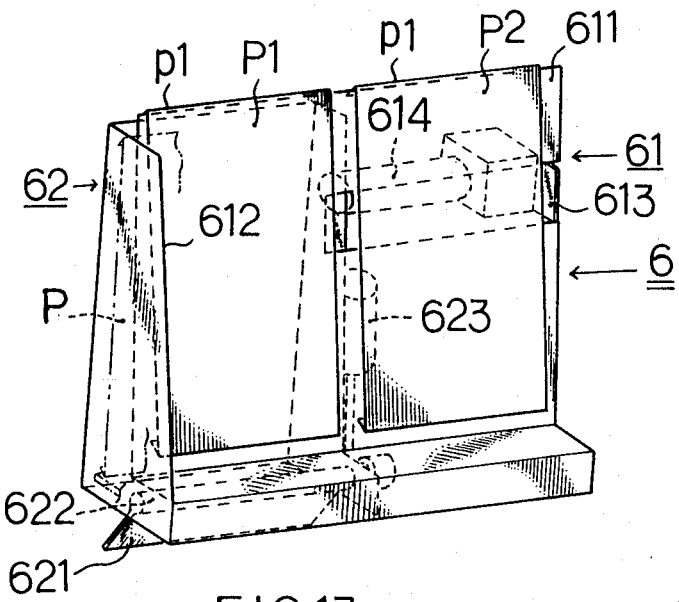
FIG. 12 is an enlarged perspective view of a principal portion of FIG. 11.

As shown in FIG. 12, the fresh-plate take-out unit 61 of the stationary type magazine 6 includes a hanger 611, a positioning plate 612 mounted on the front end of the hanger 611, plate advancing claws 613 projecting from the rear end of the hanger 611, and an air cylinder 614 for driving the claws 613. The hanger 611 has an at least horizontally extending upper edge or bar, such as panel or cross bar, from which a plurality of successive fresh printing plates P are hung in slightly forwardly inclined posture, each fresh printing plate P having a gripping-side bent end P1 hooped on the hanger 611. The length of the hanger 611, in the illustrated embodiment, substantially corresponds to the total width of the leading printing plate P1 and the second printing plate P2. However, the present invention is not limited to this embodiment and includes a hanger having a length sufficient to support more than two printing plates in order, in which case the advancing claws 613 is engaged with the rear edge of the trailing printing plate. In this case, since the amount of movement of the claws 613 is increased, the air cylinder 614 may be replaced with a clawed chain conveyor (not shown) driven by a torque motor, for example.

Since the leading printing plate P1 is thus normally positioned in a predetermined orientation and at a predetermined level (height) with respect to the main body 5, it is possible to cope with the remote take-out operation of the mechanical hand 1 precisely. Upon completion of taking out of the leading printing plate P1 by the mechanical hand 1, the above-described advancing mechanism is actuated to advance the succeeding fresh printing plates in order and then to position the plates one at a time for mounting.

Subsequently, in FIG. 12, the used-plate temporary storage unit 62 includes an at least upwardly opening box, or a predetermined space defined by a frame, disposed behind the fresh-plate take-out unit 61. The bottom side 621 of the box may be in the form of a plate, a net or a draining board, which is connected at its one edge to a shaft 622 having an arm connected to a piston rod of an air cylinder 623. As the piston rod of the air cylinder 623 is extended, the bottom side 621 of the box is opened. Reversely, as the piston rod of the air cylinder 623 is shrunk, the bottom side 621 of the box is closed.

Accordingly, a plurality of used printing plates P removed from the plate cylinder A during the plate exchanging, are introduced, by the mechanical hand 1, into the storage unit 62 and are temporarilly stored therein. Upon completion of the plate exchange, as the bottom side 621 of the box is opened, the plurality of used printing plates P are discharged to the exterior at once for disposal.

As shown in FIG. 13, the detachable cassette type magazine 6A is attached to the front side of the main body 5 and includes a fresh-plate take-out cassette 6A1, a inclined hanger 6A11 (in the illustrated embodiment, only this hanger is stationary) for positioning the leading fresh printing plate to be taken out, and a used-plate storage cassette 6A2.

Figure 14:
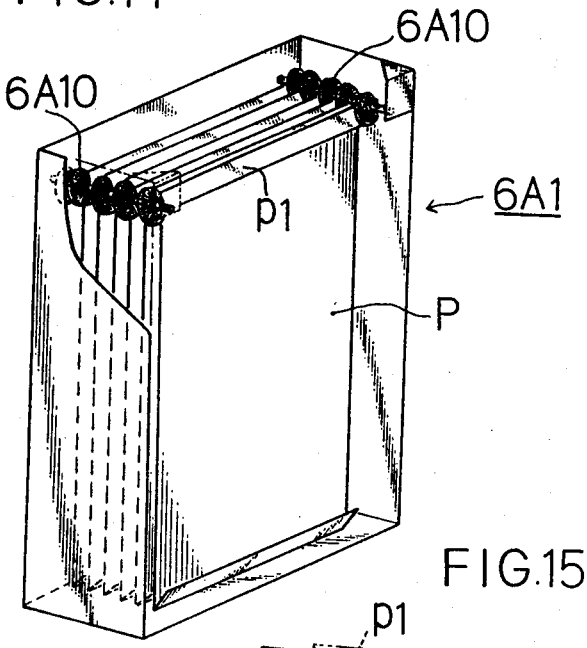
FIG. 14 is an enlarged perspective view of a principal portion of FIG. 13.

The fresh-plate take-out cassette 6A1 is detachably supported by means of an electromagnetic catch (not shown) for example, on a shelf mounted on the front side of the main body 5. On the other hand, the hanger 6A11 is in the form of a panel which is forwardly inclined and is spaced from the fresh-plate take-out cassette 6A1 by a space sufficient for at least the stroke of the mechanical hand 1 for plate take-out. The fresh printing plates P are hung from the hanger 6A11, with the gripping-side bent end P1 of each plate P hooked on the upper edge of the hanger 6A11. As shown in FIG. 14, the fresh-plate take-out cassette 6A1 is in the form of a box having at its top an inlet opening and at its front an outlet. In the box, a plurality of (eight at maximum for example) fresh printing plates P are arranged in superposed relationship in order from the front side to the rear side of the box, each fresh printing plate P being in upright posture with its gripping-side bent end P1 facing upwardly and forwardly.

The fresh printing plates P arranged in the take-out order in the cassette 6A1 can be advanced one after another by means of a pair of spiral brushes 6A10 which is mounted on the cassette 6A1 so as to contact the opposite upper portions of the printing plates P and which is driven by a non-illustrated drive means for rotation. By the action of the brushes 6A10, the leading printing plate P is sent out of the cassette 6A1 to learn against the surface of the forwardly inclined hanger 6A11. Practically, however, the fresh printing plate P thus in contact with the hanger surface is not always placed in a predetermined position in which the plate P can be taken out with ease, that is, it is inevitable that some positional error occurs.

Figure 15:
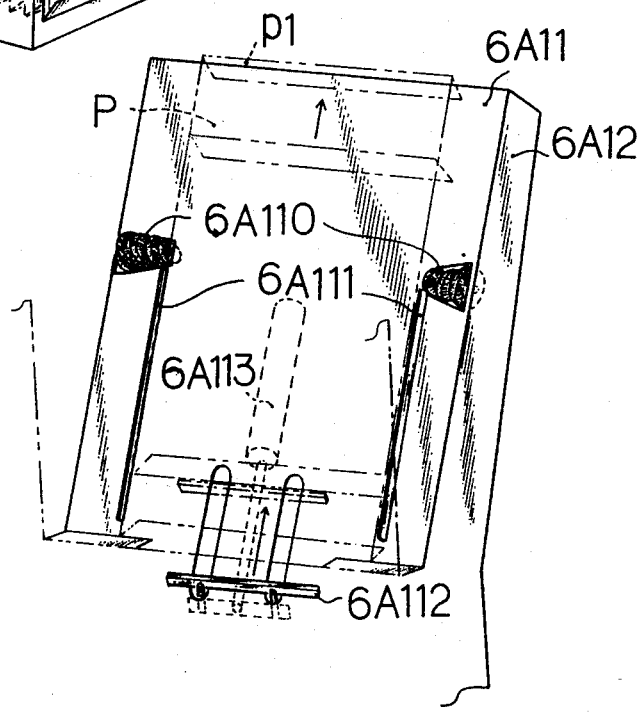
FIG. 15 is a perspective view, as viewed from the rear side, of another principal portion of FIG. 13.

To this end, as shown in FIG. 15, a fresh-plate positioning means is provided. A pair of core-shaped brushes 6A110, 6A110 is mounted on a pair of horizontal shafts supported on opposite sides of a chute 6A12, a portion of the peripheral surface of each cone-shape brush 6A110 being exposed. As each horizontal shaft is rotated by a non-illustrated drive means, the fresh printing plate P is laterally shifted so as to enter between a pair of side guide bars 6A111, 6A111. On the other hand, a shelf 6A112 is mounted on a surface of the chute 6A12 at its lower portion. As the shelf 6A112 is raised by an air cylinder 6A113, the gripping-side bent end P1 of the printing plate P is hooked on the upper edge of the hanger 6A11. Thus the stand-by position of fresh printing plates for take-out is determined both horizontally and vertically.

Further, a tubular chute 6A12 of rectangular cross section is mounted at the rear side of the hanger 6A11 for introducing the used printing plates P. The used printing plate P removed from the peripheral surface of the plate cylinder A is transported to the mouth of the chute 6A12 by the mechanical hand 1, whereupon as the mechanical hand 1 releases the used printing plate P, the latter slides downwardly through the chute 6A12 into the temporary storage cassette 6A2 disposed downwardly of the chute 6A12. Thus at the time when exchange of the used printing plates P with fresh ones has been completed, a plurality of (eight at maximum for example) used printing plates P have been stored in the cassette 6A2. The cassette 6A2 containing the used printing plates P may be withdrawn from the main body 5 at any desired time after all the used printing plates P have been completely received in the cassette 6A2, whereupon the used printing plates P are discharged out of the cassette 6A2 for disposal.

A means for introducing fresh printing plates P into the magazine 6 or 6A associated with the main body 5, will now be described in detail.

Generally, each fresh printing plate P produced by a plate-making apparatus (not shown) is labelled beforehand with an identification code showing an address, i.e. a particular printing unit to which the fresh printing plate P is to be mounted. By reading the codes, the printing plates are selected and conveyed on respective separate carriers 7, with each printing plate hanging therefrom, to the side of the respective predetermined printing unit.

A detecting means 71 is mounted at the side of each printing unit for reading the code of a printing plate P conveyed by the carrier 7. When the code on the printing plate P agrees with the reference code registered in the detecting means 71, an unloading mechanism 72 is actuated to remove the printing plate P from the hanger of the carrier 1.

A desired number of fresh printing plates P thus conveyed one to the side of each printing unit can be transported and inserted into the stationary type magazine 6 or the cassette type magazine 6A in one lot by the worker's hand. As long as this manual work is completed while the printing unit is in operation for printing by the previous or old printing plate, no time loss will be caused thereby.

However, in the event that many printing units are to be operated by only a small number of workers, it is desirable that the distance by which the printing plates are to be transported by the workers be reduced to a minimum, and if possible, it is most desirable to automate such transporting work.

For automation of the above transporting work, firstly the transporting terminal for the fresh printing plates is placed at a position which is the same level (height) as the magazine 6 or 6A and which is very close to the magazine 6 or 6A. It is desirable that the magazine 6 or 6A also approaches the transporting terminal, and ideally the transporting terminal and the magazine 6 or 6A can be connected with each other.

In the embodiments of FIGS. 11 and 16, the base 56 of the main body is movable along the plate cylinder A, while the transporting terminal 8 is aligned with the forwardly inclined hanger 611 of the stationary type magazine 6 in level (height), orientation and posture. The transporting terminal is also aligned with the inclined hanger 611 in the direction of transporting of the printing plates.

Since the carrier 7 is usually an elevated type, if the main body 5 of the mechanical hand 1 also is elevated in conformity with the level of the carrier 7 by hanging the base 56 from an elevated beam 3 so that the printing plate P is movable longitudinally of the plate cylinder A, it is possible to reduce the connecting route 9 between the carrier 7 and the transporting terminal 8 to a minimum.

On the other hand, as shown in FIG. 11, in the case where the base 56 of the main body 5 is movable by a moving means 4 (FIG. 18) located under the floor 40, the connecting route 9 between the carrier 7 and the transporting terminal 8 is extended, more than the embodiment of FIG. 6, into an L-shape which is lowered along the side wall of the rotary printing press. With this L-shaped connecting route 9, an adequate space for stand-by of and temporary storing of the fresh printing plates P can be achieved so that at maximum eight printing plates can be stood-by in order and in a row. Reference numeral 91 designates a transporting conveyor. 92 a gate mounted at a distal end of the stock portion, and 93 an advancing claw.

Figure 18:
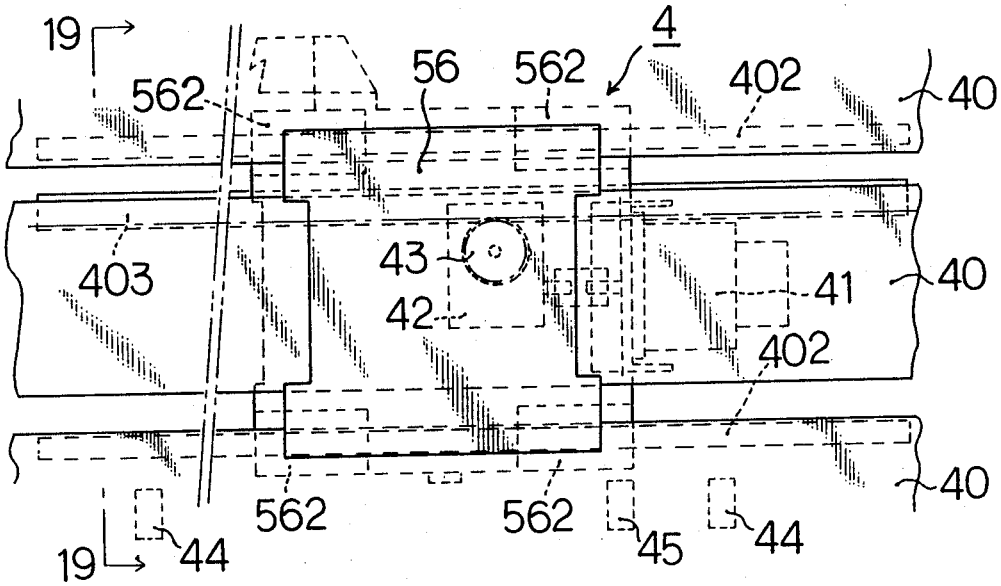
FIG. 18 is an enlarged plan view showing a floor of FIG. 11.
Figure 19:
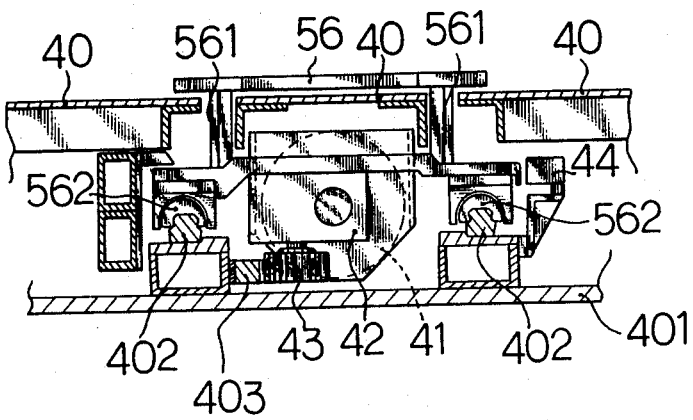
FIG. 19 is a vertical leftside cross-sectional view taken along line 19—19 of FIG. 18.

As shown in FIGS. 18 and 19, one example of the moving means includes a pair of slidable straight legs 562, 562 is mounted at the respective lower edge portions of a pair of plates 561, 561 which extends downwardly from opposite sides of the bottom of the base 56. And a pair of rails 402, 402 is mounted on an under-floor plate 401 fixed to the floor 40; each rail 402 serves to guide the respective leg 562 thereon. Further, a DC servo motor 41 is fixedly secured to the base 56, while a pinion 43 is mounted on the output shaft of the servo motor 41 via a reduction gear 42 and is in meshing engagement with a rack 403 fixed to the under-floor plate 401. Therefore, since the pinion 43 driven by the motor 41 for rotation is displaced along the rack 403, the base 56 fixed to the pinion 43 also is displaced following the pinion 43. As a result, the main body 5 is moved longitudinally of the plate cylinder A; as the main body 5 is moved rightwardly in FIG. 11, the hanger 61 of the magazine 6 is connected with the transporting terminal 8. Thus the printing plates P can be transported to the hanger 61 fully automatically. Reference numeral 44 designates an overrun preventing sensor, while 45 designates a stop-at-fixed-position sensor.

But, even in the case where the transporting terminal 8 is not aligned with the magazine 6 or 6A such as in level (height), if the position of the transporting terminal 8 is fixed, the fresh printing plates P can be taken out one after another from the transporting terminal 8 by the mechanical hand 1 and then can be introduced into the magazine 6 or 6A in one lot.

Figure 17:
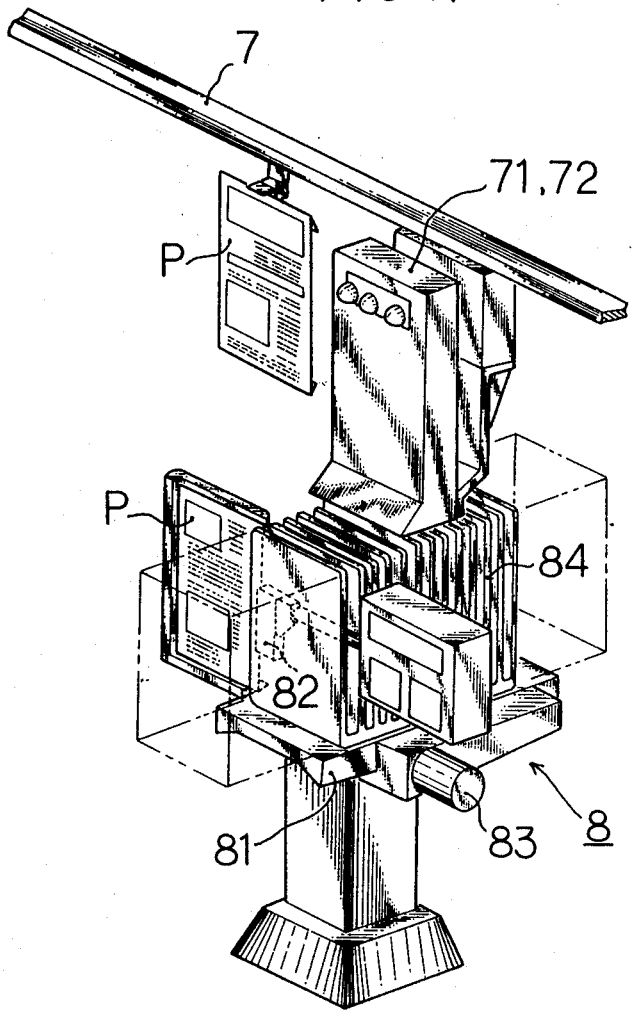
FIG. 17 is a perspective view showing another embodiment of a right half portion of each of FIGS. 11 and 13.

FIG. 7 illustrates a preferred embodiment for stocking many fresh printing plates P in a small space. After the fresh printing plates P transported by the carrier 7 are unloaded from the carrier 7 by means of the code-detecting and unloading mechanisms 71, 72, the fresh printing plates P are arranged one after another in order and in upright posture in a comb gate 84 mounted on the table 81 of the transporting terminal 8. In this case, since the fresh printing plates P are lowered in a fixed position, the table 81 is slightly or finely displaced longitudinally by the motor 83 to move the comb-shaped gate 84 in conformity with the lowering position of the fresh printing plates P so that many fresh printing plates P can be inserted into the comb-shaped gate 84 one after another in order and can be temporarily stocked there in a row. Each of the thus stocked fresh printing plates P is pushed out from one side of the gate 84 when a pusher 82 located at one side of the gate 84 is inserted into the gate 84 from the opposite side thereof. If the thus pushed fresh printing plates P are aligned with the fowardly inclined hanger 611 of the stationary type magazine 6 in level (height), orientation, posture and position in the direction of transporting the printing plates P, it is possible to transport the fresh printing plates P to the stationary type magazine 6. For bringing the inclined hanger 611 (FIG. 11) of the stationary type magazine 6 in alignment with the orientation of the fresh printing plates P pushed out according to the embodiment of FIG. 17, the main body 5 of the hanger is turned through an angle of 90° about the post 55, for instance.

If a large-width gate 84 is provided for stocking a plurality of fresh printing plates P in one lot, and if the pusher 81 has a large width corresponding to the width of the gate 84, it is possible to push many fresh printing plates P out of the gate 84 by only a single push. Accordingly, if the take-out cassette 6A (with one side open) is placed at the pushing-out-side of the gate 84, it is possible to insert a desired number of fresh printing plates P into the cassette 6A in one lot. In this side-open type cassette 6A, the mounting position of the spiral brushes 6A10 (FIG. 14) is changed such that each spiral brush 6A10 is engageable with the upper edge of the printing plate P.

Although there is no illustration in the drawings, if a very-large-width comb-like gate 84 is provided on the table 81, and if the top-side-open type cassette 6A1 of FIG. 4 is placed in the gate 84, it is possible to insert very many fresh printing plates P directly into the cassette 6A1. Further, if the main body 5 is moved beforehand for stand-by in such a manner that a cassette supporting shelf on the main body 5 of FIG. 3 is disposed at one side of the table 8 when the cassette 6a1 is pushed to this one side of the table 8 by the pusher 82, it is possible to transport the cassette 6A1 onto the main body 5.

According to the present invention, since the magazine 6 or **6*a'* is serviceable for the purposes of both the take-out of the fresh printing plates P and the temporary storage of the used printing plates P by the mechanical hand 1, the exchange of the printing plates P can be completed as the mechanical hand 1** moves within the short distance about the peripheral surface of the plate cylinder A, thus causing a considerably quick exchange of the printing plates.

Another advantageous feature of the present invention is that since a plurality of fresh printing plates P are supplied stably in order by the transporting terminal 8 located at a predetermined position, the fresh printing plates P can be introduced beforehand into the magazine 6 or 6A by the worker's hand or by the mechanical hand 1. Consequently, the take-out of the fresh printing plates P and the temporary stock of the used printing plates P by the mechanical hand 1 can be storaged without delay.

Further, because the transporting terminal 8 and the magazine 6 or 6A are interconnectable with each other, it is possible to transport the fresh printing plates P fully automatically with quickness.

With the various advantageous results discussed above, the peripheral procedures immediately before the mounting of the fresh printing plate and immediately after the removal of the used printing plate have been rationalized with remarkable success.

What is claimed is:

1. An apparatus for automatically mounting and removing a printing plate in a rotary press, said apparatus comprising:

(a) a mechanical hand including a retainer mechanism having a suction disc for retaining the plate, an inserter mechanism for forcing a gripping-side bent end of the plate into a gripping groove of a plate cylinder, a pusher mechanism for pushing the plate against a peripheral surface of the plate cylinder, a shaft supporting said retainer mechanism, said inserter mechanism and said pusher mechanism, a base supporting said shaft such that the latter is movable when thrusted, a positioning mechanism for pivotally moving said shaft relative to said base to thereby position the plate on said plate cylinder at a predetermined position;

(b) a main body having a support shaft and an arm for supporting and moving said mechanical hand;

(c) an angular displacement mechanism for angularly moving a printing-plate gripping and releasing shaft of said plate cylinder;

(d) a control mechanism for controlling motions of said mechanical hand, said main body and said angular displacement mechanism in time relative to one another for mounting and removal of the plate;

(e) a magazine attached to said main body and including a detachable fresh-plate cassette containing a purality of fresh printing plates superposed in upright posture with a gripping-side bent end of each fresh printing plate, a hanger disposed at a position ahead of said cassette, a detachable used-plate cassette mounted at a rear lower portion of said hanger for temporarily storing the used plates, and said fresh-plate cassette having means for advancing the fresh plates forwardly in order, and (f) said mechanical hand being actuated by said main body for reciprocating between said magazine and said plate cylinder.

2. An apparatus for automatically mounting and removing a printing plate in a rotary press, said apparatus comprising:

(a) a mechanical hand including a retainer mechanism having a suction disc for retaining the plate, an inserter mechanism for forcing a gripping-side bent end of the plate into a gripping groove of a plate cylinder, a pusher mechanism for pushing the plate against a peripheral surface of the plate cylinder, a shaft supporting said retainer mechanism, said inserter mechanism and said pusher mechanism, a base supporting said shaft such that the latter is movable when thrusted, a positioning mechanism for pivotally moving said shaft relative to said base to thereby position the plate on said plate cylinder at a predetermined position;

(b) a main body having a support shaft and an arm for supporting and moving said mechanical hand;

(c) an angular displacement mechanism for angularly moving a printing-plate gripping and releasing shaft of said plate cylinder;

(d) a control mechanism for controlling motions of said mechanical hand, said main body and said angular displacement mechanism in time relative to one another for mounting and removal of the plate;

(e) a magazine attached to said main body and including a plate take-out unit having a horizontally elongated hanger for supporting the successive fresh-plates in order and in a row, each of the fresh-plates adapted for hanging from said hanger by a gripping-side bent end of the plate, a positioning plate mounted on a front end of said hanger, and a projection extending from a rear end of said hanger and driven to move forwardly for advancing the successive fresh-plates in order, and a used-plate storage unit provided at rear surface of said hanger, and (f) said mechanical hand being actuated by said main body for reciprocating between said magazine and said plate cylinder.

3. An apparatus for automatically mounting and removing a printing plate in a rotary press, said apparatus comprising:

(a) a mechanical hand having a suction disc for retaining the plate at a free end portion thereof and movably supported by a main body;

(b) a magazine attached to said main body and including a plate take-out unit having a horizontally elongated hanger for supporting the successive fresh-plates in order and in a row, each of the fresh-plates adapted for hanging from said hanger by a gripping-side bent end of the plate, a positioning plate mounted on a front end of said hanger, and a projection extending from a rear end of said hanger and driven to move forwardly for advancing the successive fresh-plates in order, and a used-plate storage unit provided at rear surface of said hanger;

(c) a plate transportation terminal for receiving a desired number of fresh-plates from a carrier which is adapted to transport the fresh-plates to respective printing units, and for temporarily storing the received fresh-plates in order;

(d) means for shifting said main body longitudinally along a plate cylinder; and (e) said mechanical hand being actuated by said main body for reciprocating between said terminal and said magazine, and between said magazine and a peripheral surface of said plate cylinder.

* * * * *